US012601119B2

(12) United States Patent
Xia et al.

(10) Patent No.: US 12,601,119 B2
(45) Date of Patent: Apr. 14, 2026

(54) TRACK BEAM AND TRACK BEAM ASSEMBLY

(71) Applicant: BYD COMPANY LIMITED, Guangdong (CN)

(72) Inventors: Jun Xia, Shenzhen (CN); Hao Zeng, Shenzhen (CN); Jie Liu, Shenzhen (CN); Lin Chen, Shenzhen (CN); Qian Zhou, Shenzhen (CN)

(73) Assignee: BYD Company Limited, Shenzhen (CN)

( * ) Notice: Subject to any disclaimer, the term of this patent is extended or adjusted under 35 U.S.C. 154(b) by 549 days.

(21) Appl. No.: 18/116,179

(22) Filed: Mar. 1, 2023

(65) Prior Publication Data

US 2023/0203758 A1 Jun. 29, 2023

Related U.S. Application Data

(63) Continuation of application No. PCT/CN2021/116963, filed on Sep. 7, 2021.

(30) Foreign Application Priority Data

Sep. 8, 2020 (CN) ..... 202010937354.4

(51) Int. Cl.
*E01B 25/00* (2006.01)
*B61B 5/02* (2006.01)
(Continued)

(52) U.S. Cl.
CPC ..... *E01B 25/00* (2013.01); *B61B 5/02* (2013.01); *B61F 9/00* (2013.01); *E01B 2/00* (2013.01);
(Continued)

(58) Field of Classification Search
CPC . B61B 13/04; B61B 13/06; B61B 5/02; B61F 9/00; E01B 25/10; E01B 2204/15;
(Continued)

(56) References Cited

U.S. PATENT DOCUMENTS 915,374 A * 3/1909 Pfautz et al. ..... B61F 9/00 191/29 R
3,528,608 A * 9/1970 Janzow ..... E01B 25/10 238/151
(Continued)

FOREIGN PATENT DOCUMENTS

CN 201771198 U 3/2011
CN 104746393 A 7/2015
(Continued)

OTHER PUBLICATIONS

International Search Report and Written Opinion for Application No. PCT/CN2021/116963, mailed on Dec. 8, 2021, 8 pages.
(Continued)

*Primary Examiner* — Zachary L Kuhfuss
(74) *Attorney, Agent, or Firm* — Sheppard Mullin Richter & Hampton LLP

(57) ABSTRACT

A track beam includes a main component and a guide component. The main component includes a top plate, a bottom plate, and a web plate. The bottom plate is disposed below the top plate, and the web plate is connected between the top plate and the bottom plate. The guide component includes a guide plate and a connecting structure. The guide plate is disposed between the top plate and the bottom plate. The guide plate includes a planar plate structure extending in a longitudinal direction and is spaced apart from the web plate in a transverse direction. The connecting structure is connected between the main component and the guide plate
(Continued)

such that the guide plate is connected to the main component through the connecting structure.

19 Claims, 6 Drawing Sheets

(51) Int. Cl.

| | |
|---|---|
| ***B61F 9/00*** | (2006.01) |
| ***E01B 2/00*** | (2006.01) |
| ***E01B 25/10*** | (2006.01) |
| ***E01B 25/24*** | (2006.01) |
| ***E01D 2/02*** | (2006.01) |
| *B61B 13/04* | (2006.01) |

(52) U.S. Cl.
CPC ..... *E01B 2/003* (2013.01); *E01B 25/10* (2013.01); *E01B 25/24* (2013.01); *E01D 2/02* (2013.01); *B61B 13/04* (2013.01); *E01B 2202/025* (2013.01); *E01B 2202/027* (2013.01); *E01B 2204/15* (2013.01)

(58) Field of Classification Search
CPC . E01B 2/00; E01B 25/00; E01B 2/003; E01B 2202/025; E01B 2202/027; E01B 1/00; E01D 2/02; E01D 19/12; Y02E 10/50
USPC ..... 104/124
See application file for complete search history.

(56) References Cited

U.S. PATENT DOCUMENTS 4,274,336 A 6/1981 Pater et al.
4,702,173 A * 10/1987 Perrott ..... B61F 9/00 104/96

FOREIGN PATENT DOCUMENTS

| | | | |
|---|---|---|---|
| CN | 107190592 | A | 9/2017 |
| CN | 107190595 | B | 9/2017 |
| CN | 209010948 | U | 6/2019 |
| CN | 210163736 | U | 3/2020 |
| CN | 210608467 | U | 5/2020 |
| CN | 111364312 | A | 7/2020 |
| CN | 211340225 | U | 8/2020 |
| CN | 211340228 | U | 8/2020 |
| CN | 112575622 | A | 3/2021 |
| WO | 2004/106135 | A1 | 12/2004 |

OTHER PUBLICATIONS

Office Action dated Feb. 5, 2025, issued in Philippines Patent Application No. 1/2023/550620 (4 pages).
First Office Action dated Jul. 5, 2022, issued in Chinese Patent Application No. 202010937354.4, with English machine translation (10 pages).
Office Action dated Jun. 12, 2024, issued in Canadian Patent Application No. 3,191,414 (4 pages).
Search Report dated Feb. 10, 2025, issued in Brazilian Patent Application No. 112023004243-7, with English machine translation (8 pages).

* cited by examiner

TRACK BEAM AND TRACK BEAM ASSEMBLY

CROSS-REFERENCE TO RELATED APPLICATIONS

This application is a Continuation Application of International Patent Application No. PCT/CN2021/116963, filed on Sep. 7, 2021, which is based on and claims priority to and benefits of Chinese Patent Application No. 202010937354.4 filed on Sep. 8, 2020. The entire content of all of the above Applications is incorporated herein by reference.

FIELD

The present disclosure relates to the technical field of bridges, and more specifically, to a track beam and a track beam assembly.

BACKGROUND

In the technical field of bridges, a position and accuracy of a guide plate directly affect the travel safety of rail vehicles. The construction of the guide plate is difficult, and the accuracy is difficult to guarantee in the related art.

SUMMARY

The present disclosure provides a track beam. The track beam has the advantages such as easy construction, a high guide accuracy, and the like.

The present disclosure provides a track beam assembly. The track beam assembly has the track beam as described above.

The track beam according to an embodiment of the present disclosure includes a main component and a guide component. The main component includes a top plate, a bottom plate, and a web plate. The bottom plate is disposed below the top plate. The web plate is connected between the top plate and the bottom plate. The guide component includes a guide plate and a connecting structure. The guide plate is disposed between the top plate and the bottom plate. The guide plate includes a planar plate structure extending in a longitudinal direction and is spaced apart from the web plate in a transverse direction. The connecting structure is connected between the main component and the guide plate such that the guide plate is connected to the main component through the connecting structure.

A separate guide plate is arranged on the track beam according to the embodiment of the present disclosure. The guide plate is a vertically arranged planar plate structure extending in the longitudinal direction and is spaced apart from the web plate in the transverse direction. The guide plate is connected with the main component through the connecting structure. Therefore, the track beam according to the present disclosure has the following advantages. First, a distance between the web plate and a center line of the track beam may be shortened, resulting in a reasonable stress distribution of the main component. Therefore, the main component does not need to be thickened, thereby saving an amount of steel used and reducing costs. Second, materials of the web plate and the guide plate may be separately selected and machined into structures and shapes that meet respective use requirements, without needing to machine the web plate or the guide plate into a complex structure for connecting the web plate to the guide plate. Therefore, the track beam of the present disclosure is easy to machine and construct, and during the construction, there is no need to add a temporary device due to the complex structure of the web plate or the guide plate to prevent the deformation of the web plate or the guide plate, which saves manpower and material resources. Third, it is easier to ensure the guiding accuracy of the guide surface when the guide plate is separately machined, with no need to machine the web plate to meet the guiding accuracy, thereby reducing the machining difficulty and costs. Fourth, by assembling the guide plate to the main component by using the connecting structure, it is easier to ensure that a distance between the guide plates of two track beams meets the design requirements.

In some embodiments, the web plate includes a planar plate structure extending in the longitudinal direction. An upper end of the web plate is connected with the top plate, and/or a lower end of the web plate is connected with the bottom plate.

In some embodiments, the connecting structure is detachably connected with the main component and/or the guide plate.

In some embodiments, the connecting structure is connected with the web plate.

In some embodiments, the connecting structure is threaded or welded to the web plate and the guide plate.

In some embodiments, the connecting structure includes a longitudinal connecting plate. The longitudinal connecting plate includes a planar plate structure extending in the longitudinal direction. Two transverse ends of the longitudinal connecting plate are respectively connected with the web plate and the guide plate.

In some embodiments, an upper end of the guide plate is welded to the top plate, a lower end of the guide plate is welded to a first end of the two transverse ends of the longitudinal connecting plate, a second end of the two transverse ends of the longitudinal connecting plate is welded to the web plate; or the lower end of the guide plate is welded to the bottom plate, the upper end of the guide plate is welded to the first end of the two transverse ends of the longitudinal connecting plate, and the second end of the two transverse ends of the longitudinal connecting plate is welded to the web plate.

In some embodiments, the connecting structure includes a transverse adjustment assembly. The transverse adjustment assembly is connected between the web plate and the guide plate and is configured to adjust a transverse spacing between the web plate and the guide plate.

In some embodiments, the connecting structure includes a plurality of transverse adjustment assemblies, and the transverse adjustment assemblies are disposed at intervals in the vertical direction connecting the guide plate and the web plate.

In some embodiments, the transverse adjustment assembly includes a plurality of transverse adjustment mechanisms disposed at intervals in the longitudinal direction. Each of the transverse adjustment mechanisms is connected between the web plate and the guide plate to adjust the transverse spacing between the web plate and the guide plate.

In some embodiments, each of the transverse adjustment mechanisms includes a support rod having a first end and a second end. The first end has threads and extends through the web plate to connect with the web plate through a first nut, and the second end is welded to the guide plate; or the first end has threads and extends through the web plate, to connect with the web plate through the first nut, and the second end has threads and extends through the guide plate to connect with the guide plate through a second nut; or the first end is welded to the web plate, and the second end has threads and extends through the guide plate to connect with the guide plate through the second nut.

In some embodiments, the connecting structure includes a support member. The support member is connected between the web plate and the guide plate. The support member includes a support portion. The support portion is spaced apart from the web plate in the transverse direction and is supported on a side surface of the guide plate facing the web plate.

In some embodiments, the support member is configured to adjust a transverse spacing between the support portion and the web plate.

In some embodiments, the guide plate is connected with the web plate through a plurality of support members disposed at intervals in the longitudinal direction.

In some embodiments, the support member includes a bent rod structure including the support portion and two connecting portions connected with an upper end and a lower end of the support portion. Each of the connecting portions extends through the web plate to connect with the web plate through the nuts.

In some embodiments, the guide component further includes a guide stiffening plate. The guide stiffening plate includes a planar plate structure extending in the longitudinal direction. The guide stiffening plate is disposed between the guide plate and the web plate. A first transverse end of the guide stiffening plate is connected with the guide plate, and a second transverse end of the guide stiffening plate is spaced apart from the web plate.

In some embodiments, the main component includes a longitudinal stiffening plate. The longitudinal stiffening plate includes a planar plate structure extending in the longitudinal direction. The longitudinal stiffening plate is disposed between the top plate and the bottom plate and connected on a side surface of the web plate facing the guide plate. A transverse end of the longitudinal stiffening plate is welded to the web plate.

In some embodiments, the longitudinal stiffening plate extends between two longitudinal ends of the track beam.

In some embodiments, the main component includes a plurality of longitudinal stiffening plates disposed at intervals in the vertical direction.

In some embodiments, the main component further includes one or more transverse stiffening plates. Each of the one or more transverse stiffening plates includes a planar plate structure extending in the transverse direction. The one or more transverse stiffening plates are disposed at intervals in the longitudinal direction between the top plate and the bottom plate and disposed on the side surface of the web plate facing the guide plate. A transverse end of each of the one or more transverse stiffening plates is welded to the web plate.

In some embodiments, the track beam further includes: a limiting structure, where the limiting structure is disposed on a top surface of the top plate and a groove is defined between the limiting structure and the top plate, or the limiting structure is disposed on a top surface of the bottom plate and the groove is defined between the limiting structure and the bottom plate; and a pavement structure, where the pavement structure is paved in the groove.

In some embodiments, the limiting structure includes two limiting plates. The two limiting plates include planar plates respectively extending in the longitudinal direction and spaced apart in the transverse direction. The groove is formed between the two limiting plates.

The track beam assembly according to the embodiment of the present disclosure includes a connection beam assembly and one or more track beams according to the above. The one or more track beams are disposed and spaced apart in a transverse direction, and the connection beam assembly is connected between the one or more track beams.

According to the track beam assembly in the embodiment of the present disclosure, the stress distribution of the main component is reasonable, which can save an amount of steel used and reduce costs. The track beam is easy to machine and construct, and there is no need to add a temporary structure to prevent the deformation thereof, thereby saving manpower and material resources. In addition, it is easier to ensure the guide accuracy of a guide surface during machining of the guide plate. In the width direction of a rail vehicle, it is also easier to ensure that a distance between the guide surfaces of the two track beams meets design requirements.

Some of the additional aspects and advantages of the present disclosure are to be given in the following description, and become apparent in the following description or understood through the practice of the present disclosure.

BRIEF DESCRIPTION OF THE DRAWINGS

The foregoing and/or additional aspects and advantages of the present disclosure will become apparent and easy to understand in the description of the embodiments made with reference to the following accompanying drawings.

REFERENCE NUMERALS

Figure 1:
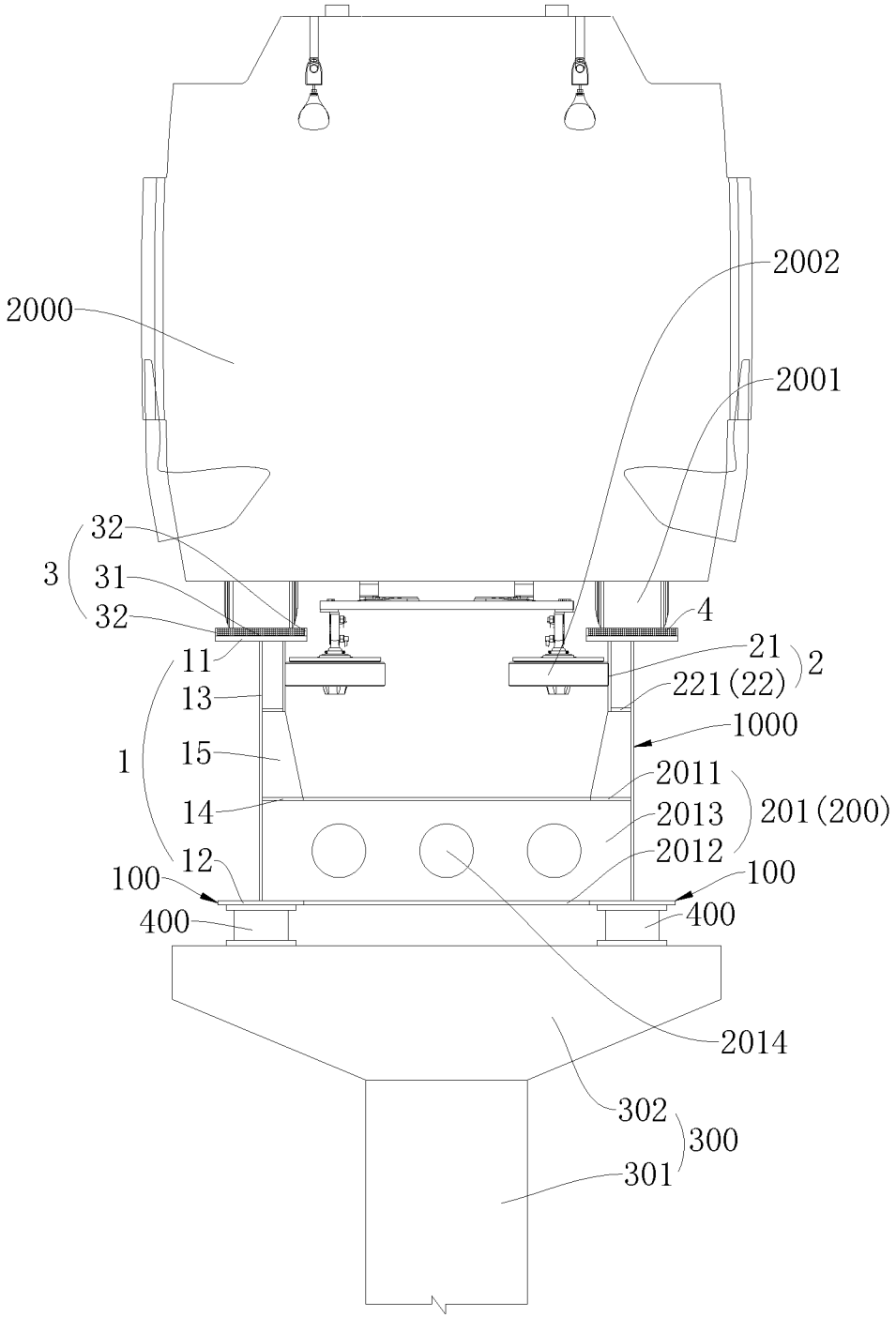
FIG. 1 is a schematic diagram showing engagement between a track beam assembly and a rail vehicle according to an embodiment of the present disclosure.

Track beam assembly 1000, Track beam 100,

Main component 1, Top plate 11, Bottom plate 12, Web plate 13, Longitudinal stiffening plate 14, Transverse stiffening plate 15, Guide component 2, Guide plate 21, Connecting structure 22, Longitudinal connecting plate 221, Transverse adjustment assembly 222, Transverse adjustment mechanism 222*a*, Support rod 2221, First end 2222, Second end 2223, Nut 2224, Support member 223, Support portion 2231, Connecting portion 2232, Guide stiffening plate 23, Limiting structure 3, Groove 31, Limiting plate 32, Pavement structure 4, Connection beam assembly 200, Connection beam 201, First beam 2011, Second beam 2012, Transverse web plate 2013, Wiring hole 2014, Bridge pier 300, Support post 301, Capping beam 302, Support 400, Rail vehicle 2000, Walking wheel 2001, and Horizontal wheel 2002.

DETAILED DESCRIPTION

Embodiments of the present disclosure are described in detail below, and examples of the embodiments are shown in the accompanying drawings, where the same or similar elements or elements having the same or similar functions are represented by the same or similar reference numerals throughout the description. The embodiments described below with reference to the accompanying drawings are exemplary and used only for explaining the present disclosure, and should not be construed as a limitation on the present disclosure.

A track beam 100 and a track beam assembly 1000 according to the embodiments of the present disclosure are described below with reference to the accompanying drawings. The track beam assembly 1000 includes two separated track beams 100. A rail vehicle 2000 may walk and stay on the track beam assembly 1000. The rail vehicle 2000 includes walking wheels 2001 and horizontal wheels 2002.

Figure 2:
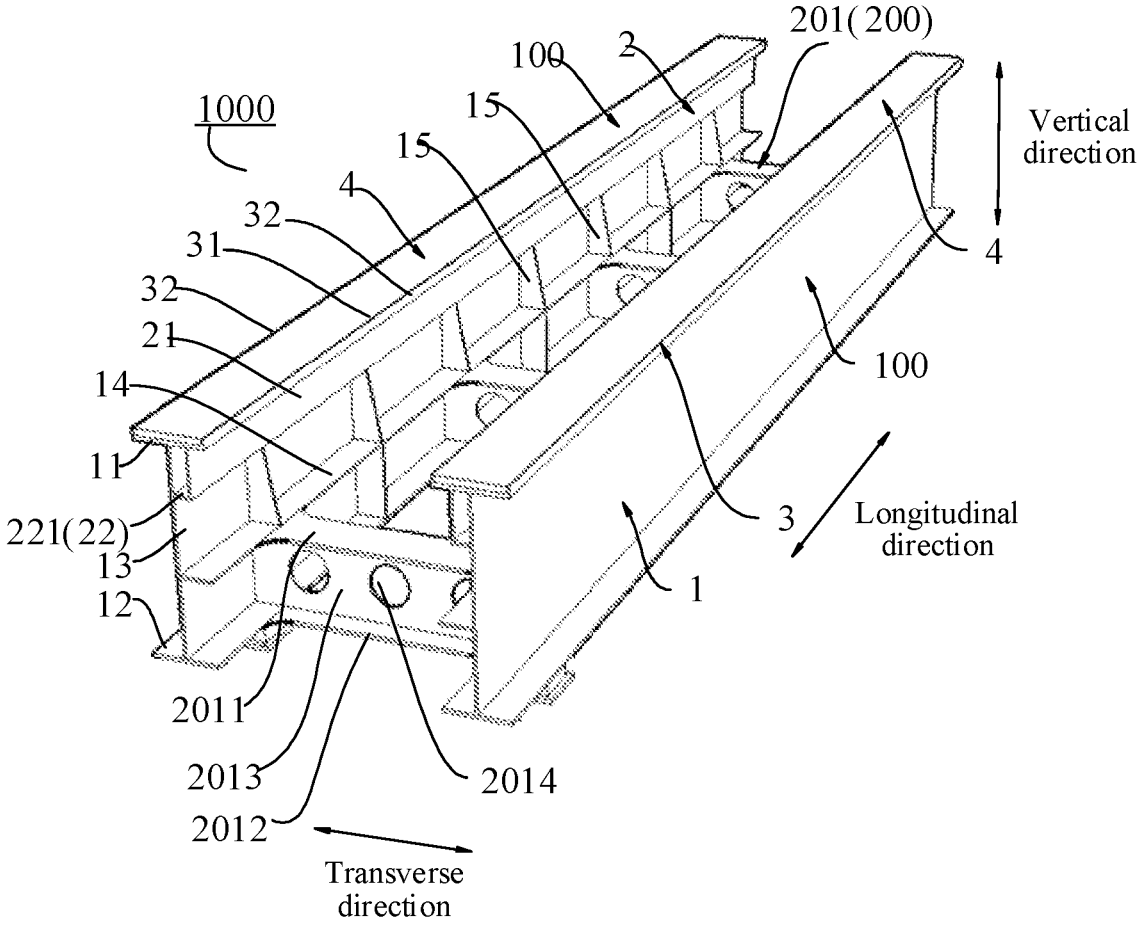
FIG. 2 is a schematic diagram of the track beam assembly shown in FIG. 1.

As shown in FIG. 1 and FIG. 2, the track beam 100 according to an embodiment of the present disclosure includes a main component 1 and a guide component 2. The main component 1 may provide a walking track for the walking wheels 2001 and support the rail vehicle 2000. The guide component 2 may provide guidance and support for the horizontal wheels 2002, to cause the horizontal wheels 2002 to reliably guide the rail vehicle 2000.

Specifically, referring to FIG. 1 and FIG. 2, the main component 1 includes a top plate 11, a bottom plate 12, and a web plate 13. The bottom plate 12 is arranged below the top plate 11, and the web plate 13 is connected between the top plate 11 and the bottom plate 12. Therefore, when the rail vehicle 2000 is a straddle-type rail vehicle, the bottom plate 12 may support the web plate 13, the web plate 13 may support the top plate 11, and the top plate 11 may be configured to support the walking and staying of the rail vehicle 2000. When the rail vehicle 2000 is a suspended rail vehicle, the top plate 11 may be configured to suspend the web plate 13, the web plate 13 may be configured to suspend the bottom plate 12, and the bottom plate 12 may be configured to support the walking and staying of the rail vehicle 2000. In order to simplify the description, the rail vehicle 2000 being the straddle-type rail vehicle is used as an example for description of this specification. It is obvious that a person skilled in the art can understand specific implementations of the rail vehicle 2000 being the suspended rail vehicle after reading the following technical solution. Therefore, the details are not described.

Refer to FIG. 1 to FIG. 2. The guide component 2 includes a guide plate 21 and a connecting structure 22. The guide plate 21 is arranged between the top plate 11 and the bottom plate 12. The guide plate 21 is a vertically arranged planar plate structure extending in a longitudinal direction and is spaced apart from the web plate 13 in a transverse direction. The connecting structure 22 is assembled and connected with the main component 1 and the guide plate 21, to connect the guide plate 21 to the main component 1 through the connecting structure 22. In this way, the main component 1 may provide a mounting environment for the guide plate 21, and the connecting structure 22 may connect the guide plate 21 to the main component 1. It should be noted that, "the transverse direction" described herein is defined as a width direction of the rail vehicle 2000, and "the longitudinal direction" is defined as a moving direction of the rail vehicle 2000.

In addition, it should be noted that "the connecting structure 22 is assembled and connected with the web plate 13 and the guide plate 21" described herein means that the connecting structure 22, the web plate 13, and the guide plate 21 are separately machined, or the connecting structure 22 and the web plate 13 are not an integrated part machined together, but need to be connected together by using an assembly process (including welding, threaded connection, and the like). The connecting structure 22 and the guide plate 21 are not an integrated part machined together, but need to be connected together by using an assembly process (including welding, threaded connection, and the like).

In this way, since the guide plate 21 and the web plate 13 may be separately made, materials of the web plate 13 and the guide plate 21 may be separately selected and machined into structural shapes that meet respective use requirements, without needing to machine the web plate 13 or the guide plate 21 into a complex structure that connects the web plate and the guide plate. In an embodiment, since the connecting structure 22 is arranged/disposed, shapes of the guide plate 21 and the web plate 13 do not need to be specially changed for the connection. For example, it is unnecessary to machine the guide plate 21 into a complex structure, and it is also unnecessary to machine the web plate 13 into a complex structure. Therefore, the web plate 13 and the guide plate 21 may be both simple structures such as plates, which reduces the machining difficulty and costs.

In addition, the guide plate 21 and the web plate 13 are not required to have the same machining accuracy and material. For example, materials of the guide plate 21 and the web plate 13 may be separately selected and machined according to requirements for supporting strength of the web plate 13 and guiding accuracy of the guide plate 21, so as to reduce production costs and better satisfy various requirements. It should be noted that, the material of the main component 1 and the guide component 2 may be, but is not limited to, steel or a concrete reinforcement plate, and the like.

In the related art, in a track beam structure, the web plate of the track beam assembly is used as both a supporting structure for supporting the top plate and a guide plate for guiding the rail vehicle. In order to save the amount of steel used in the web plate, the center line of the web plate of the track beam assembly does not coincide with the center lines of the top plate and the bottom plate, which may cause the whole track beam assembly to be in an off-centered stress distribution for a long time. In order to meet the stress distribution requirements, a thickness of the top plate and thicknesses of the bottom plate and the web plate need to be increased to meet the stress distribution requirements, which increases the amount of steel used and further increase the cost. However, the effect is not ideal. In addition, the off-centered track beam structure is complicated to machine, and weld seams are not symmetrical in the process of construction, and out-of-plane deformation is easily caused during the welding. In order to solve the problem, additional temporary devices need to be added to prevent the deformation. However, the temporary devices need to be welded on the track beam assembly at first, and then need to be removed after use. The construction is difficult, and the manpower and material resources are wasted.

In addition, as the guide plate to meet driving requirements, on the one hand, the web plate should be kept perpendicular to the top plate, and on the other hand, it is necessary to ensure that the distance between the two guide surfaces in the width direction of the rail vehicle is not excessively big or excessively small to ensure the guiding function. Since the overall rigidity of the track beam assembly is relatively large, and the track beam assembly is a welded structure with relatively discrete welding deformations, the web plate which is used as a guide plate requires a pretty high accuracy. In order to ensure the accuracy, the cost is high to control the deformation of the top plate, the bottom plate, and the web plate during the construction, and the effect is not ideal. In addition, machining the web plate having a large area for high guiding accuracy is costly.

A separate guide plate 21 is arranged on the track beam 100 according to the embodiment of the present disclosure. The guide plate 21 is a vertically arranged planar plate structure extending in the longitudinal direction and is spaced apart from the web plate 13 in the transverse direction. The guide plate 21 is connected with the main component 1 through the connecting structure 22. Therefore, the track beam 100 according to the present disclosure has the following advantages. First, a distance between the web plate 13 and a center line of the track beam 100 may be shortened, to cause a reasonable stress distribution of the main component 1. Therefore, the main component 1 does not need to be thickened, thereby saving an amount of steel used and reducing costs. Second, materials of the web plate 13 and the guide plate 21 may be separately selected and machined into structural shapes that meet respective use requirements, without needing to machine the web plate 13 or the guide plate 21 into a complex structure for connecting the web plate to the guide plate. Therefore, the track beam 100 of the present disclosure is easy to machine and construct, and during the construction, there is no need to add a temporary device due to the complex structure of the web plate 13 or the guide plate 21 to prevent the deformation of the web plate 13 or the guide plate 21, which saves manpower and material resources. Third, it is easier to ensure the guiding accuracy of the guide surface when the guide plate 21 is separately machined, with no need to machine the web plate 13 to meet the guiding accuracy, thereby reducing the machining difficulty and costs. Fourth, by assembling the guide plate 21 to the main component 1 using the connecting structure 22, it is easier to ensure that a distance between the guide plates 21 of two track beams 100 meets the design requirements.

In some embodiments of the present disclosure, as shown in FIG. 1 and FIG. 2, the web plate 13 may also be a vertically arranged planar plate structure extending in the longitudinal direction. Therefore, the structure of the web plate 13 is simple and easy to machine. For example, the web plate may be made of a simple plate such as a steel plate to effectively support the top plate 11, to cause the top plate 11 to be reliably used for the rail vehicle 2000 to walk and stay. It should be noted herein that the "vertically arranged" herein is not limited to vertical, for example, may also mean being inclined to the vertical direction. In some embodiments, as shown in FIG. 1, the guide plate 21 and the web plate 13 may be parallel, so as to facilitate the machining.

With reference to FIG. 1, according to some embodiments of the present disclosure, an upper end of the web plate 13 is connected with a transverse middle portion of the top plate 11, and/or a lower end of the web plate 13 is connected with a transverse middle portion of the bottom plate 12. That is to say, in some embodiments, the upper end of the web plate 13 may be connected with the transverse middle portion of the top plate 11. In other embodiments, the lower end of the web plate 13 may be connected with the transverse middle portion of the bottom plate 12. In still other embodiments, the upper end of the web plate 13 may be connected with the transverse middle portion of the top plate 11, and the lower end of the web plate 13 may be connected with the transverse middle portion of the bottom plate 12. Therefore, the distance between the web plate 13 and a center line of the track beam 100 may be better shortened, to cause the stress distribution of the main component 1 to be reasonable. Therefore, the top plate 11 and the web plate 13 do not need to be thickened, thereby saving the amount of steel used and reducing the cost.

In addition, it should be noted that when an upper end of the web plate 13 is connected with a transverse middle portion of the top plate 11, and/or a lower end of the web plate 13 is connected with a transverse middle portion of the bottom plate 12, the web plate 13 may be a vertically arranged planar plate structure extending in the longitudinal direction. Therefore, the structure of the main component 1 can be simplified, to cause the main component 1 to substantially present an I-beam design.

Certainly, the present disclosure is not limited thereto. When the web plate 13 is a vertically arranged planar plate structure extending in a longitudinal direction, the upper end of the web plate 13 may also be connected with a non-middle portion of the top plate 11, and the lower end of the web plate 13 may also be connected with a non-middle portion of the bottom plate 12. The connection of the web plate 13 with any position of the top plate 11 and the bottom plate 12 may be used as an achievable implementation of the present disclosure, which is not limited herein.

In addition, the present disclosure is not limited thereto. The web plate 13 may also be a non-planar plate structure. That is to say, a structural shape of the web plate 13 may be selected according to an actual requirement and an actual construction condition. For example, the web plate 13 of the non-planar plate structure may be a curved plate, such as a corrugated plate, a cambered plate, and the like. The details are not described herein. Any shaped structure of the web plate 13 may be an achievable implementation of the present disclosure. The structural shape of the web plate 13 is not limited herein. The web plate 13 with any shaped structure may fall within the protection scope of the present disclosure.

For example, in some embodiments, an upper end of the web plate 13 of the non-planar plate structure may be connected with the transverse middle portion of the top plate 11, and/or the lower end of the web plate 13 of the non-planar plate structure is connected with the transverse middle portion of the bottom plate 12. That is, in some embodiments, the upper end of the web plate 13 of the non-planar plate structure may be connected with the transverse middle portion of the top plate 11. In other embodiments, the lower end of the web plate 13 of the non-planar plate structure may be connected with the transverse middle portion of the bottom plate 12. In still other embodiments, the upper end of the web plate 13 of the non-planar plate structure may be connected with the transverse middle portion of the top plate 11, and the lower end of the web plate 13 of the non-planar plate structure may be connected with the transverse middle portion of the bottom plate 12.

For example, in some other embodiments, the upper end of the web plate 13 of the non-planar plate structure may also be connected with the non-middle portion of the top plate 11, and/or the lower end of the web plate 13 of the non-planar plate structure may also be connected with the non-middle portion of the bottom plate 12, and so on. The connection of the web plate 13 of the non-planar plate structure with any position of the top plate 11 and the bottom plate 12 may be used as an achievable implementation of the present disclosure, which is not limited herein.

Figure 4:
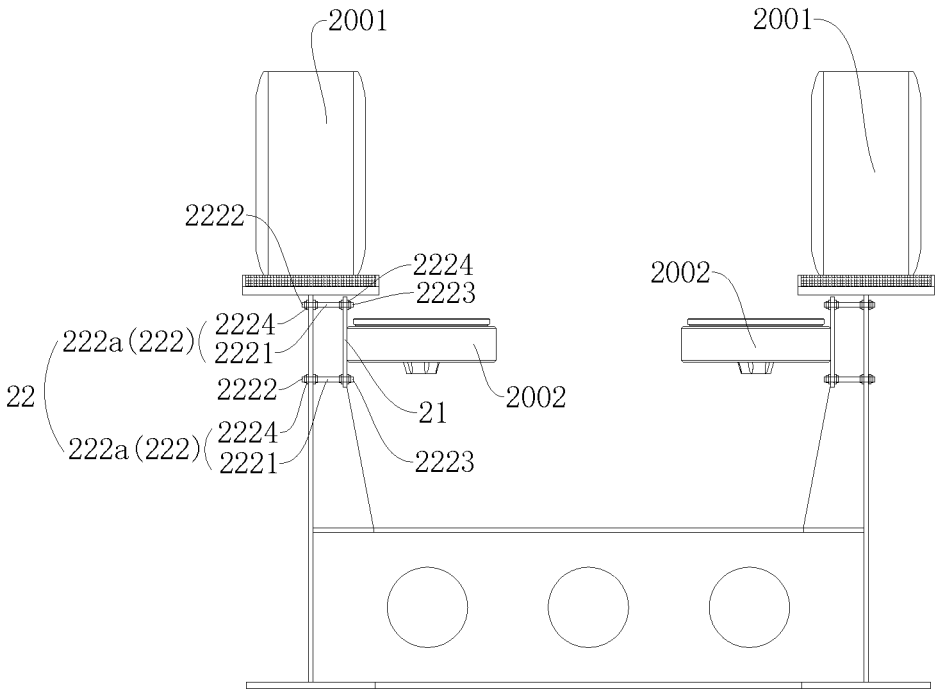
FIG. 4 is a schematic diagram showing engagement between a track beam assembly and wheels of a rail vehicle according to an embodiment of the present disclosure.
Figure 5:
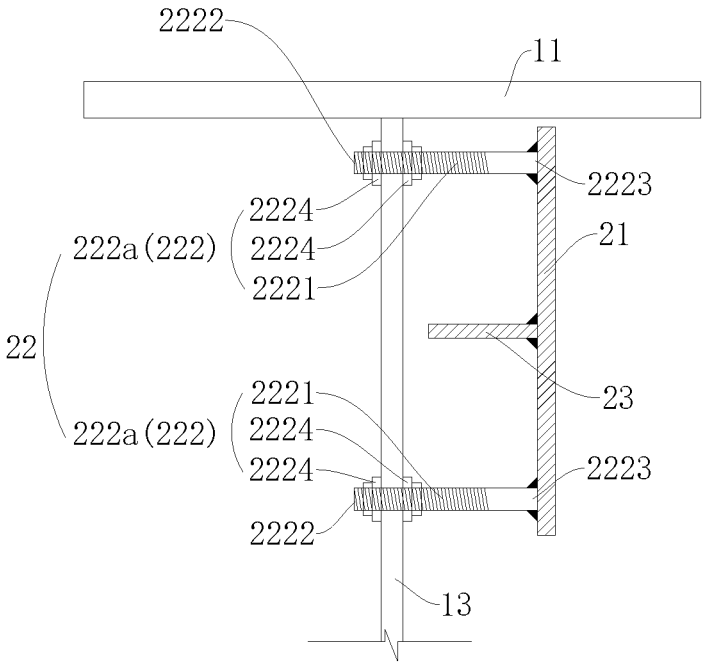
FIG. 5 is a partial schematic diagram of a track beam according to an embodiment of the present disclosure.
Figure 6:
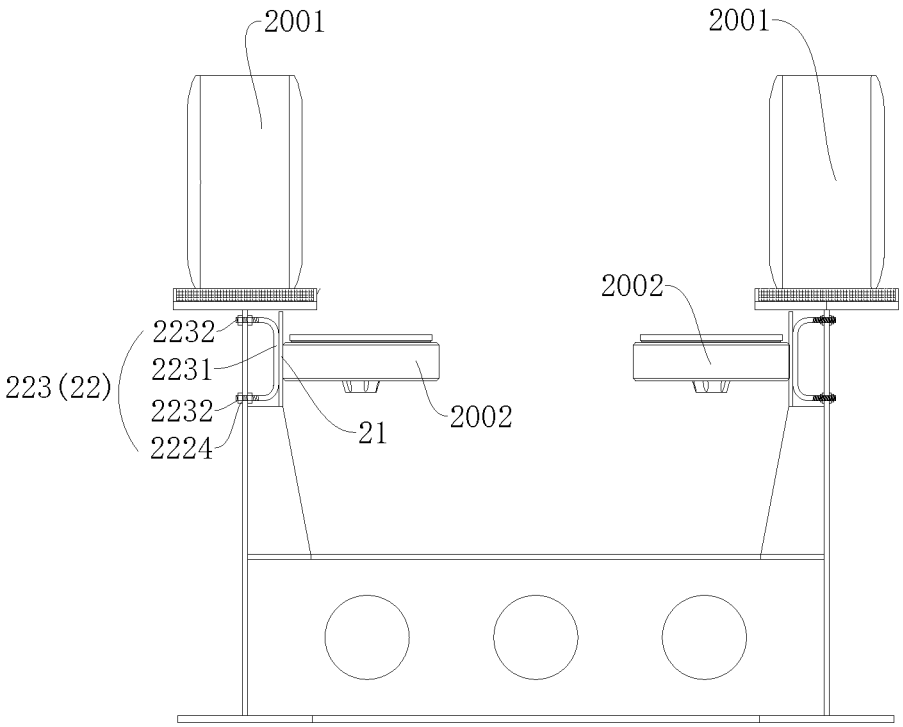
FIG. 6 is a schematic diagram showing engagement between a track beam assembly and wheels of a rail vehicle according to an embodiment of the present disclosure.

In some embodiments of the present disclosure, as shown in FIG. 4 to FIG. 6, the connecting structure 22 is detachably assembled and connected with the main component 1, and/or detachably assembled and connected with the guide plate 21. In this way, through the above arrangement, the guide plate 21 may be disassembled relative to the main component 1, to cause the guide plate 21 to be easily replaced or repaired after being worn. In this way, since there is no need to replace or repair the main component 1, the maintenance costs can be reduced.

In the related art, the web plate is directly worn by a guide wheel. On the one hand, the web plate of a main beam is worn, which affects the structural strength of the whole track beam assembly. On the other hand, a tire of the guide wheel is worn, which affects the service life of the tire of the guide wheel. In addition, the web plate may become smooth after friction for a long time, to cause a friction coefficient to be reduced, which affects braking and starting of the guide wheel, and the influence is more obvious when the road is slippery in rainy days. However, the web plate is a part of the main structure of the track beam assembly, which is difficult to replace or maintain after wear and the costs is high. In the present disclosure, the guide plate 21 is arranged as described above, so that the guide plate 21 is removable relative to the main component 1, thereby protecting the web plate 13 and alleviating the wear of the guide plate 21.

In some embodiments of the present disclosure, as shown in FIG. 1, the connecting structure 22 is assembled and connected with the web plate 13. Therefore, the difficulty of connection between the connecting structure 22 and the main component 1 can be reduced. In addition, the impact on the operation of the rail vehicle 2000 when the connecting structure 22 is connected with the top plate 11 or the bottom plate 12 can be avoided, thereby ensuring the smooth operation of the rail vehicle 2000. Certainly, the present disclosure is not limited thereto. The connecting structure 22 may further be arranged to be assembled and connected with the main component 1 in other more manners, and the details are not described herein.

In some embodiments of the present disclosure, the connecting structure 22 is threaded with or welded to the web plate 13, and the connecting structure 22 is threaded with or welded to the guide plate 21. Therefore, the assembly is easy and the reliability is high. In addition, when the connecting structure 22 is threaded with the web plate 13, and/or the connecting structure 22 is threaded with the guide plate 21, the guide plate 21 can be further detachably connected with the main component 1 through the connecting structure 22, so as to facilitate debugging, maintenance, and replacement of the guide plate 21.

Figure 3:
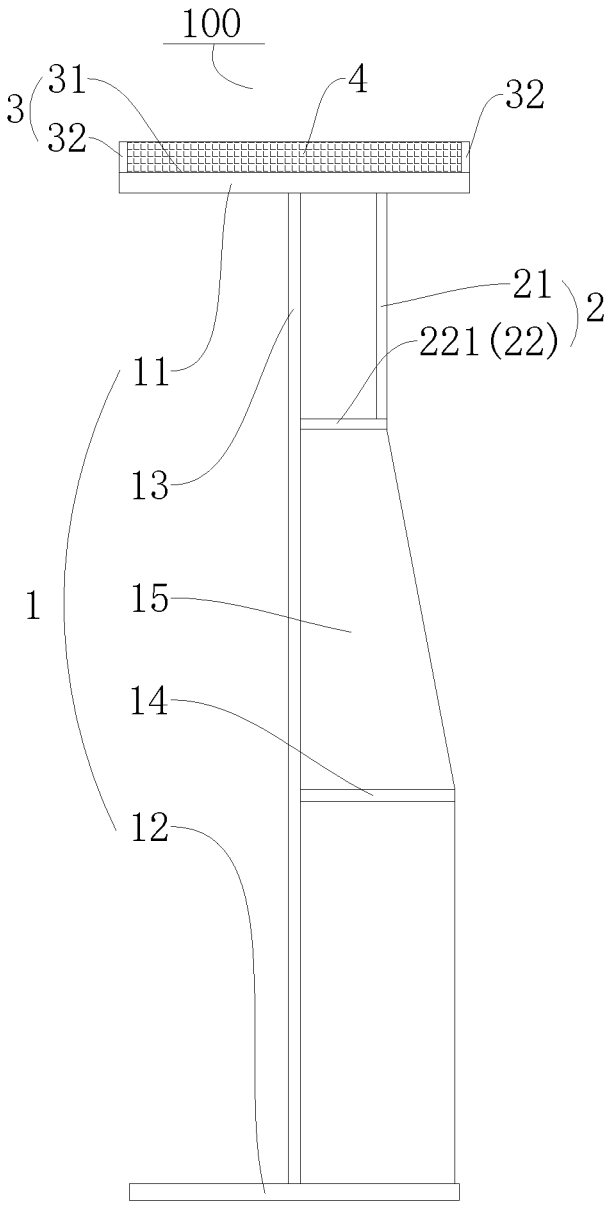
FIG. 3 is a partial schematic diagram of a track beam shown in FIG. 2.

Referring to FIG. 1 to FIG. 3, in some embodiments of the present disclosure, the connecting structure 22 includes a longitudinal connecting plate 221. The longitudinal connecting plate 221 is a transversely arranged planar plate structure extending in the longitudinal direction. Two transverse ends of the longitudinal connecting plate 221 are respectively connected with the web plate 13 and the guide plate 21. Therefore, the longitudinal connecting plate 221 can simply, effectively, and reliably connect the guide plate 21 to the web plate 13, so as to ensure that a certain transverse distance is reliably defined between the guide plate 21 and the web plate 13, to cause the centering arrangement of the web plate 13 to be more realistic, and the guide plate 21 is supported to guide the horizontal wheels 2002 more reliably. In addition, the longitudinal connecting plate 221 may further strengthen the structural strength of the web plate 13.

According to some embodiments of the present disclosure, in an example shown in FIG. 1 to FIG. 3, an upper end of the guide plate 21 is welded to the top plate 11, a lower end of the guide plate 21 is welded to one transverse end (e.g., a first transverse end) of the longitudinal connecting plate 221, and the other transverse end (e.g., a second transverse end) of the longitudinal connecting plate 221 is welded to the web plate 13, so as to be applicable to the straddle-type rail vehicle. In an embodiment, the lower end of the guide plate 21 is welded to the bottom plate 12, the upper end of the guide plate 21 is welded to one transverse end of the longitudinal connecting plate 221, and the other transverse end of the longitudinal connecting plate 221 is welded to the web plate 13. Therefore, the guide plate may be applied to the suspended rail vehicle. Therefore, the longitudinal connecting plate 221 and the guide plate 21 both may be reliably connected with the main component 1, and the assembly is convenient and the reliability is high.

Certainly, when the connecting structure 22 includes the longitudinal connecting plate 221, the connection manner between the guide plate 21 and the main component 1 is not limited thereto. For example, in some other embodiments, when the guide plate 21 is welded to the longitudinal connecting plate 221, the guide plate 21 is not welded to either the top plate 11 or the bottom plate 12. In this case, a plurality of longitudinal connecting plates 221 may be arranged, the longitudinal connecting plates 221 arranged at intervals in the vertical direction of the guide plate 21, and the guide plate 21 is welded to the plurality of longitudinal connecting plates 221. In an embodiment, the connecting structure 22 further includes a plurality of transverse connecting plates (not shown) arranged at intervals in the longitudinal direction. The transverse connecting plates and the longitudinal connecting plates 221 are all welded between the guide plate 21 and the web plate 13. Details are not described herein.

In some embodiments of the present disclosure, as shown in FIG. 4, the connecting structure 22 includes a transverse adjustment assembly 222. The transverse adjustment assembly 222 is connected between the web plate 13 and the guide plate 21, to adjust a transverse spacing between the web plate 13 and the guide plate 21. It may be understood that the transverse adjustment assembly 222 can facilitate the connection of the guide plate 21 to the web plate 13, and the transverse adjustment assembly 222 also facilitates the adjustment of the distance between the guide plate 21 and the web plate 13, to cause the distance between the guide plates 21 of two track beams 100 of the rail vehicle 2000 in the width direction to satisfy the driving requirement more easily.

With reference to FIG. 4, according to some embodiments of the present disclosure, the guide plate 21 is connected with the web plate 13 through a plurality of transverse adjustment assemblies 222 arranged at intervals in the vertical direction. The vertical direction may be understood as a height direction of the rail vehicle 2000, and the plurality of transverse adjustment assemblies 222 are arranged at intervals in the vertical direction to connect the guide plate 21 to the web plate 13, which can improve the connecting strength, to cause the connection between the guide plate 21 and the web plate 13 to be more reliable.

With reference to FIG. 4, according to some embodiments of the present disclosure, the transverse adjustment assemblies 222 include a plurality of transverse adjustment mechanisms 222*a* arranged at intervals in the longitudinal direction. Each of the transverse adjustment mechanisms 222*a* is connected between the web plate 13 and the guide plate 21, to adjust the transverse spacing between the web plate 13 and the guide plate 21. It may be understood that the plurality of transverse adjustment mechanisms 222*a* arranged at intervals in the longitudinal direction can reduce input costs and an overall weight of the transverse adjustment assemblies 222 while ensuring the connecting reliability, and reduce the loss and risk caused by the guide plate 21 falling off the web plate 13. In addition, the plurality of transverse adjustment mechanisms 222*a* are connected between the web plate 13 and the guide plate 21 at intervals in the longitudinal direction, to facilitate adjustment of the distances of the web plate 13 and the guide plate 21 at each position in the longitudinal direction. Therefore, the distance between the guide plates 21 of two track beams 100 of the rail vehicle 2000 in the width direction can satisfy the driving requirement more easily.

According to some embodiments of the present disclosure, referring to FIG. 4 and FIG. 5, each of the transverse adjustment mechanisms 222*a* includes a support rod 2221. Two transverse ends of the support rod 2221 are respectively a first end 2222 and a second end 2223. In an example shown in FIG. 5, the first end 2222 has threads and extends through the web plate 13, so as to be snugly connected with the web plate 13 through nuts 2224, and the second end 2223 is welded to the guide plate 21. In an embodiment, as shown in FIG. 4, the first end 2222 has threads and extends through the web plate 13, so as to be snugly connected with the web plate 13 through the nuts 2224. The second end 2223 has threads and extends through the guide plate 21, so as to be snugly connected with the guide plate 21 through the nuts 2224. In an embodiment, the first end 2222 is welded to the web plate 13, and the second end 2223 has threads and extends through the guide plate 21, so as to be snugly connected with the guide plate 21 through the nuts 2224. It may be understood that the transverse adjustment mechanisms 222*a* in the above three examples can facilitate the connection of the guide plate 21 to the web plate 13, and also facilitate the removal of the guide plate 21 from the web plate 13, which facilitates the maintenance and replacement of the guide plate 21. In addition, the distance between the guide plate 21 and the web plate 13 may be further easily adjusted through the transverse adjustment mechanisms 222*a* in the above three examples.

With reference to FIG. 6, according to some embodiments of the present disclosure, the connecting structure 22 includes a support member 223. The support member 223 is connected between the web plate 13 and the guide plate 21. The support member 223 includes a support portion 2231, and the support portion 2231 is spaced apart from the web plate 13 in the transverse direction and is supported on a side of the guide plate 21 close to the web plate 13. In addition, the support member 223 not only can reliably connect the guide plate 21 to the web plate 13, but also can use the support portion 2231 to provide reliable support for the guide plate 21, so as to improve the guidance reliability of the guide plate 21. In addition, since the support portion 2231 is spaced apart from the web plate 13 in the transverse direction, a volume, a weight, and materials of the support member 223 can be reduced to a certain extent while ensuring the transverse position of the guide plate 21, thereby reducing the costs.

In some embodiments, the support portion 2231 and the guide plate 21 may be in line contact and/or surface contact. The surface contact between the support portion 2231 and the guide plate 21 can increase a contact area between the guide plate 21 and the support portion 2231, so as to support the guide plate 21 more reliably.

In some embodiments, the support member 223 is adjustably connected with the web plate 13, to cause the transverse spacing between the support portion 2231 and the web plate 13 to be adjustable. Therefore, the distance between the guide plates 21 of two track beams 100 of the rail vehicle 2000 in the width direction can satisfy the driving requirement more easily.

With reference to FIG. 6, in some embodiments of the present disclosure, the guide plate 21 is connected with the web plate 13 through a plurality of support members 223 arranged at intervals in the longitudinal direction. Therefore, the plurality of support members 223 arranged at intervals in the longitudinal direction can strengthen the connection strength between the web plate 13 and the guide plate 21, so as to reduce the loss and risk caused by the guide plate 21 falling off the web plate 13, and reduce the input cost and the overall weight of the support member 223. In addition, the plurality of support members 223 are connected between the web plate 13 and the guide plate 21 at intervals in the longitudinal direction, to facilitate adjustment of the distances of the web plate 13 and the guide plate 21 at each position in the longitudinal direction. Therefore, the distance between the guide plates 21 of two track beams 100 of the rail vehicle 2000 in the width direction can satisfy the driving requirement more easily.

According to some embodiments of the present disclosure, as shown in FIG. 6, each of the support members 223 is a bent rod structure and includes the support portion 2231 and two connecting portions 2232 connected with an upper end and a lower end of the support portion 2231. Each of the connecting portions 2232 extends from the support portion 2231 toward the web plate 13 and extends through the web plate 13, so as to be snugly connected with the web plate 13 through the nuts 2224. Therefore, the support member 223 can facilitate the mounting of the guide plate 21 to the web plate 13, and also facilitate the removal of the guide plate 21 from the web plate 13, which facilitates the maintenance and replacement of the guide plate 21. In addition, the support member 223 is threaded with the web plate 13 through the connecting portions 2232, which facilitates the adjustment of the distance between the guide plate 21 and the web plate 13. Therefore, the distance between the guide plates 21 of two track beams 100 of the rail vehicle 2000 in the width direction can satisfy the driving requirement more easily.

In some embodiments of the present disclosure, as shown in FIG. 4 to FIG. 6, the upper end of the guide plate 21 is not connected with the top plate 11, and the lower end of the guide plate 21 is not connected with the bottom plate 12. Therefore, the guide plate 21 only needs to be connected with the web plate 13, which can make the construction simple.

With reference to FIG. 5, according to some embodiments of the present disclosure, the guide component 2 further includes a guide stiffening plate 23. The guide stiffening plate 23 is a transversely arranged planar plate structure extending in the longitudinal direction. The guide stiffening plate 23 is arranged between the guide plate 21 and the web plate 13. One transverse end of the guide stiffening plate 23 is connected with the guide plate 21, and the other transverse end of the guide stiffening plate 23 is spaced apart from the web plate 13. Therefore, the structural strength of the guide plate 21 can be strengthened, to cause the guide plate 21 to guide the horizontal wheels 2002 more reliably. It should be noted that, the "transversely arranged" described herein is not limited to a horizontal direction, for example, may be inclined to the horizontal direction.

As shown in FIG. 1 and FIG. 2, in some embodiments of the present disclosure, the main component 1 includes a longitudinal stiffening plate 14. The longitudinal stiffening plate 14 is a transversely arranged planar plate structure extending in the longitudinal direction, and the longitudinal stiffening plate 14 is located between the top plate 11 and the bottom plate 12 and arranged on a side of the web plate 13 close to the guide plate 21. A transverse end of the longitudinal stiffening plate 14 is welded to the web plate 13. Therefore, the longitudinal stiffening plate 14 can be reliably connected with the web plate 13, and the longitudinal stiffening plate 14 can strengthen the structural strength of the web plate 13. In a specific example shown in FIG. 2, the longitudinal stiffening plate 14 extends from a longitudinal end of the track beam 100 to the other longitudinal end of the track beam 100. Therefore, the structural strength of the web plate 13 can be further strengthened.

Specifically, in order to satisfy the driving requirements, the track beam assembly 1000 adopts two I-shaped track beams 100 arranged at intervals, so as to form a beam with a cross section being an upper open section, which has a poor transverse bending resistance and overall torsional stiffness. However, during movement of the rail vehicle 2000, the track beam assembly bears a relatively large transverse horizontal force, including a transverse wind load and a transverse swaying force of the vehicle. When the I-shaped structure is used, the stiffness in the horizontal direction is relatively small, and the deformation is relatively large. The web plate is prone to out-of-plane buckling, and structures such as an inclined brace need to be additionally arranged, which causes high machining difficulty and high costs. According to the present disclosure, the structural stress distribution of the web plate 13 can be improved by arranging the longitudinal stiffening plate 14 on the web plate 13, thereby solving the problem of poor out-of-plane stiffness of the web plate 13 of the universal beam.

According to some embodiments of the present disclosure, as shown in FIG. 1 and FIG. 2, the main component 1 includes a plurality of longitudinal stiffening plates 14 arranged at intervals in the vertical direction. Therefore, the plurality of longitudinal stiffening plates 14 can further strengthen the structural strength of the web plate 13. In addition, for example, in some embodiments, when the plurality of longitudinal stiffening plates 14 are arranged at intervals in the vertical direction, one of the longitudinal stiffening plates 14 may be further used as the above longitudinal connecting plate 221 to connect the guide plate 21 to the web plate 13.

Referring to FIG. 1 and FIG. 2, in some embodiments of the present disclosure, the track beam 100 further includes a transverse stiffening plate 15. The transverse stiffening plate 15 is a vertically arranged planar plate structure extending in the transverse direction. A plurality of transverse stiffening plates 15 are arranged at intervals in the longitudinal direction. Each of the transverse stiffening plates 15 is located between the top plate 11 and the bottom plate 12 and arranged on a side of the web plate 13 close to the guide plate 21. A transverse end of the transverse stiffening plate 15 is welded to the web plate 13. In this way, the stiffness of the web plate 13 can be increased. In addition, when the transverse stiffening plate 15 is connected with the longitudinal stiffening plate 14, the transverse stiffening plate 15 may also be used to constrain the longitudinal stiffening plate 14, to improve the overall stiffness of the main component 1. In addition, after the transverse stiffening plate 15 is arranged, the thickness of the web plate 13 can be thinned, thereby saving steel.

According to some embodiments of the present disclosure, as shown in FIG. 1 and FIG. 2, the track beam 100 further includes a limiting structure 3 and a pavement structure 4. The limiting structure 3 is arranged on a top surface of the top plate 11 and a groove 31 with an open top is defined between the limiting structure and the top plate 11. In an embodiment, the limiting structure 3 is arranged on a top surface of the bottom plate 12 and the groove 31 with an open top is defined between the limiting structure and the bottom plate 12. The pavement structure 4 is paved in the groove 31. It should be noted that, the pavement structure 4 includes all paved layers, for example, an epoxy asphalt pavement layer, a bridge deck waterproof layer, and the like. The walking wheel 2001 directly contacts the pavement structure 4, and moves and stays on the pavement structure 4. In this way, the walking wheel 2001 can be prevented from directing abrading the top plate 11, and the wear of the walking wheel 2001 can also be reduced. In addition, when the pavement structure 4 includes the bridge deck waterproof layer, the pavement structure 4 may prevent the top plate 11 from being directly eroded by rain. Besides, the pavement structure 4 may distribute concentrated loads of the rail vehicle 2000, so as to improve a stress distribution of the top plate 11.

Moreover, the pavement structure 4 may further improve a skid-resistance required coefficient of friction between the walking wheel 2001 and the track beam 100. The pavement structure 4 is manufactured after the main component 1 and the guide component 2 are manufactured and constructed, so as to facilitate the control of flatness, a line type, and elevation of the track beam 100. In addition, the pavement structure 4 is easy to maintain, and the impact on the main component 1 and the guide component 2 can be reduced during the maintenance. Besides, the pavement structure 4 can reduce the impact with the rail vehicle 2000, thereby improving the safety and comfort of travelling. In addition, the groove 31 is manufactured by arranging the limiting structure 3. Therefore, the groove 31 can provide a mounting environment for the pavement structure 4 and limit a position of the pavement structure 4, to cause the pavement structure 4 to be more reliable and stably paved on the top plate 11 or the bottom plate 12.

In some embodiments of the present disclosure, as shown in FIG. 1 and FIG. 2, the limiting structure 3 includes two limiting plates 32. The two limiting plates 32 are vertically arranged planar plates respectively extending in the longitudinal direction and spaced apart in the transverse direction. The groove 31 is formed between the two limiting plates 32. Therefore, the groove 31 may be defined by the two limiting plates 32 and the top surface of the top plate 11. The groove 31 may provide a mounting environment for the pavement structure 4 and limit the position of the pavement structure 4, to cause the pavement structure 4 to be more reliable and stably paved on the top plate 11 or the bottom plate 12.

With reference to FIG. 1 and FIG. 2, the track beam assembly 1000 according to the embodiment of the present disclosure includes a connection beam assembly 200 and the track beam 100 according to the above. Two track beams 100 are arranged and spaced apart in the transverse direction, and the connection beam assembly 200 is connected between the two track beams 100. Therefore, the two track beams 100 may provide support and a walking surface for the two walking wheels 2001 of the rail vehicle 2000, and may provide support and a guide surface for the two horizontal wheels 2002 of the rail vehicle 2000. The two track beams 100 are connected by the connection beam assembly 200, so as to improve the structural reliability of the track beam assembly 1000.

In some embodiments, as shown in FIG. 1 and FIG. 2, when the track beam assembly 1000 is an inner guide double-rail track, the guide plate 21 of each of the track beams 100 is arranged facing the other of the track beams 100. When the track beam assembly 1000 is an outer guide double-rail track, the guide plate 21 of each track beam 100 is arranged facing away from the other track beam 100.

According to the track beam assembly 1000 in the embodiment of the present disclosure, the stress distribution of the main component 1 is reasonable. Therefore, the top plate 11 and the web plate 13 do not need to be thickened, which can save the amount of steel used and reduce the cost. The track beam 100 is easy to machine and construct, and there is no need to add a temporary structure to prevent the deformation thereof, thereby saving manpower and material resources. The guide plate 21 of the track beam assembly 1000 in the present disclosure is convenient for maintenance and replacement. In addition, it is easier to ensure the guide accuracy of a guide surface during machining of the guide plate 21. In a width direction of the rail vehicle 2000, it is also easier to ensure that a distance between the guide surfaces of the two track beams 100 meets design requirements.

In some embodiments of the present disclosure, as shown in FIG. 1 and FIG. 2, the connection beam assembly 200 includes a plurality of connection beams 201 arranged at intervals in the longitudinal direction. Each of the connection beams 201 includes a first beam 2011 and a second beam 2012 spaced apart in the vertical direction, and a transverse web plate 2013 connected between the first beam 2011 and the second beam 2012. A wiring hole 2014 is formed on the transverse web plate 2013. Two transverse ends of the first beam 2011 are respectively connected with the longitudinal stiffening plates 14 of the two track beams 100, two transverse ends of the second beam 2012 are respectively connected with the bottom plates 12 of the two track beams 100, and two transverse ends of the transverse web plate 2013 are respectively connected with the web plates 13 of the two track beams 100. In this way, the connection beam assembly 200 may reliably connect the two track beams 100 together, so that the track beam assembly 1000 safely and reliably provides support for the rail vehicle 2000.

With reference to FIG. 1 and FIG. 2, according to some embodiments of the present disclosure, the track beam assembly 1000 may further include a bridge pier 300 and a plurality of supports 400. The bridge pier 300 includes a support post 301 and a capping beam 302. The capping beam 302 is arranged on the top of the support post 301, the plurality of supports 400 is arranged on the top of the capping beam 302, and the two track beams 100 are arranged on the plurality of supports 400. Therefore, the support post 301 can support the capping beam 302, the capping beam 302 can support the plurality of supports 400, and the plurality of supports 400 can reliably and stably support the two track beams 100.

The track beam assembly 1000 according to the embodiment of the present disclosure is described below.

As shown in FIG. 1, the track beam assembly 1000 of the present disclosure includes a bridge pier 300, a plurality of supports 400, two track beams 100, and a connection beam assembly 200 connecting the two track beams 100. The connection beam assembly 200 includes a plurality of connection beams 201 arranged at intervals in the longitudinal direction of the track beam 100. The bridge pier 300 includes a support post 301 and a capping beam 302. Each of the track beams 100 includes a main component 1, a guide component 2, a limiting structure 3, and a pavement structure 4.

Specifically, referring to FIG. 1 and FIG. 2, the main component 1 includes a top plate 11, a web plate 13, a bottom plate 12, a longitudinal stiffening plate 14, and a transverse stiffening plate 15. Center lines of the top plate 11, the web plate 13, and the bottom plate 12 coincide. The guide component 2 includes a guide plate 21 and a connecting structure 22, and the guide plate 21 may be a walking plate of the horizontal wheel 2002. The pavement structure 4 includes all paved layers, for example, an epoxy asphalt pavement layer, a bridge deck waterproof layer, and the like. The limiting structure 3 includes two limiting plates 32 transversely arranged on two ends of the top plate 11. The groove 31 is defined by the two limiting plates 32 and the top plate 11, and the groove 31 may accommodate the pavement structure 4.

As shown in FIG. 1 and FIG. 2, the connection beam 201 is an I-shaped section, including the first beam 2011, the second beam 2012, and the transverse web plate 2013. A wiring hole 2014 is formed on the transverse web plate 2013, which can allow necessary pipelines of communication, signals, strong and weak electricity of the rail vehicle 2000 to pass through the transverse web plate 2013, thereby making full use of the narrow space of the track beam assembly 1000. A diameter of the wiring hole 2014 is determined by a size of the transverse web plate 2013 and a quantity of pipelines. In addition, the wiring hole 2014 may also function to reduce the weight of the transverse web plate 2013.

With reference to FIG. 1 and FIG. 2, the pavement structure 4 is arranged on the main component 1 of the track beam assembly 1000 of the present disclosure, which has the following advantages. First, the problem of friction between the walking wheel 2001 and the top plate 11 of the rail vehicle 2000 can be solved, and the walking wheel 2001 may be prevented from direct abrading the top plate 11, thereby reducing the wear on the main component 1 and the wear on the tire of the walking wheel 2001. Second, the top plate 11 is protected, to protect the top plate 11 from direct erosion of the rain. Third, concentrated loads of the weight of the rail vehicle 2000 may be distributed, so as to improve the stress distribution of the top plate 11. Fourth, the skid-resistance required coefficient of friction between the walking wheel 2001 and the track beam 100 may be ensured. Fifth, since the pavement structure 4 is manufactured upon completion of the main component 1, the thickness of the pavement layer may be adjusted to meet the requirements for the elevation and line type, so as to facilitate the control of the flatness, the line type, and the elevation of the track beam 100. Sixth, the maintenance is convenient, and the impact on the main component 1 can be reduced during the maintenance. Seventh, the impact of the rail vehicle 2000 can be reduced, thereby improving the safety and comfort of the travelling.

It should be noted that, the pavement layer of the pavement structure 4 may be made of various materials that meet the requirements. The requirements may include flatness, skid resistance, wear resistance, adaptability of steel plate deformed, fatigue resistance, aging resistance, and the like. One pavement layer may be an epoxy asphalt layer, and a thickness of the pavement structure 4 is determined by the stress distribution and construction. A size of the pavement layer may range from 20 mm to 50 mm, and a waterproof bonding layer is added between the epoxy asphalt layer and the top plate 11. The waterproof bonding layer functions to bond the epoxy asphalt layer and the top plate 11 as a whole, and fully utilize the combined effect of the pavement layer and the top plate 11, thereby improving the condition of the stress distributions of the top plate 11 and the pavement structure 4, and enhancing the fatigue resistance of the pavement structure 4.

Referring to FIG. 1 and FIG. 2, the limiting structure 3 is arranged on the main component 1 of the track beam assembly 1000 of the present disclosure. That is to say, the limiting plate 32 extending in the longitudinal direction of the top plate 11 is added on each of two transverse sides of the top plate 11. Conventional asphalt bridge deck pavement is rolled by an asphalt road roller, which is wide in the transverse direction and requires multi-pass rolling. A lapping width is also required during the rolling. However, the track beam 100 of the present disclosure is very narrow in the transverse direction and the pavement structure 4 is not easy to construct. The limiting structure 3 is a special structure invented according to the characteristics that the track beam 100 is very narrow in the transverse direction and the pavement structure 4 is not easy to construct. The limiting structure has the following advantages. First, the pavement structure 4 is limited in the transverse direction during the construction, which facilitates the construction of the pavement structure 4. Second, the pavement structure 4 is prevented from deformation toward both sides under the extrusion of the walking wheel 2001 during the operation, which leads to destruction and peeling of an edge. A height of the limiting plate 32 in the vertical direction may be the same as the pavement structure 4, and the thickness in the transverse direction is determined by the stress distribution and the structure. One thickness size in the transverse direction may range from 6 mm to 12 mm. In addition, the steel plate is required not to invade the bottom of the walking wheel 2001, to prevent the walking wheel 2001 from being pressed on two different materials such as the pavement structure 4 and the limiting plate 32.

As shown in FIG. 1 and FIG. 2, in the track beam assembly 1000 of the present disclosure, the guide plate 21 is manufactured separately from the web plate 13. The track beam assembly has the following advantages. First, the accuracy of a distance between the guide surfaces of the guide plates 21 of the two track beams 100 is easier to control. Since the guide plate 21 bears a relatively horizontal force from the horizontal wheel 2002, the guide plate 21 may be made thinner. Compared with the web plate 13, the height and the thickness of the guide plate can be greatly reduced, which facilitates the machining and the accuracy control. Second, the stress distribution is more reasonable. The center line of the web plate 13 coincides with the center lines of the top plate 11 and the bottom plate 12, and also coincides with the center line of the walking wheel 2001. The main component 1 is not off-centered, and the rail vehicle 2000 is not off-centered relative to the track beams 100, so that a stress distribution is more reasonable than that of an off-centered I-shaped beam. Third, the maintenance is easy, and the guide plate 21 may be partially replaced after partial damage, which does not affect the stress distribution of the main component 1. Fourth, the cost is saved. Compared with the off-centered I-shaped beam, the guide plate 21 is added, but a total amount of steel used is less since the structure is more reasonable and the thicknesses of the top plate 11 and the bottom plate 12 may be properly thinned. Fifth, the construction is more convenient, and the welding deformation is reduced. Since the main component 1 is a symmetrical member, left and right deformed surfaces may offset each other during the welding of the steel plate, and the welding deformation direction is easier to control than that of the off-centered component.

According to the track beam assembly 1000 of the present disclosure, the guide plate 21 is connected with the main component 1 in a plurality of manners, which is described by using examples below.

For example, referring to FIG. 3, one end of the guide plate 21 may be welded to the top plate 11, and another end of the guide plate 21 may be welded to a longitudinal connecting plate 221. One transverse end of the longitudinal connecting plate 221 is welded to the guide plate 21, and the other transverse end of the longitudinal connecting plate 221 is welded to the web plate 13. Therefore, the guide plate 21 may be reliably welded to the main component 1, the guide plate 21, the top plate 11, the web plate 13, and the longitudinal connecting plate 221 may form a box, and the guide plate 21 and the longitudinal connecting plate 221 may jointly participate in the structural stress distribution. In this way, the overall stiffness of the track beam 100 is relatively large. On the one hand, the longitudinal connecting plate 221 may provide support for the guide plate 21, so that the guide plate 21 becomes a simply-supported load-carrying structure having a favorable stress distribution and a small deformation. On the other hand, the longitudinal connecting plate 221 may provide out-of-plane stiffness for the web plate 13, preventing local buckling of the web plate 13.

For another example, with reference to FIG. 4 and FIG. 5, the guide plate 21 is disconnected from the top plate 11, and the guide plate 21 is connected with the web plate 13 through a plurality of transverse adjustment assemblies 222 that are vertically arranged. The transverse adjustment assemblies 222 include a plurality of transverse adjustment mechanisms **222*a* arranged at intervals in the longitudinal direction. Each of the transverse adjustment mechanisms 222*a* is connected between the web plate 13 and the guide plate 21. Each of the transverse adjustment mechanisms 222*a* includes a support rod 2221. Two transverse ends of the support rod 2221 are respectively a first end 2222 and a second end 2223. In an example shown in FIG. 5, the first end 2222 has threads and extends through the web plate 13, so as to be snugly connected with the web plate 13 through nuts 2224, and the second end 2223 is welded to the guide plate 21**.

In an embodiment, as shown in FIG. 4, the first end 2222 has threads and extends through the web plate 13, so as to be snugly connected with the web plate 13 through the nuts 2224. The second end 2223 has threads and extends through the guide plate 21, so as to be snugly connected with the guide plate 21 through the nuts 2224. In an embodiment, the first end 2222 is welded to the web plate 13, and the second end 2223 has threads and extends through the guide plate 21, so as to be snugly connected with the guide plate 21 through the nuts 2224. It may be understood that the above three examples have the following advantages. First, the distance between the guide plates 21 of two track beams 100 of the rail vehicle 2000 in the width direction can satisfy the driving requirement more easily. Second, the welding may be reduced, which is beneficial to the deformation control. Third, the assembly operation can be realized, and the construction is convenient and fast.

For another example, referring to FIG. 6, the guide plate 21 is connected with the web plate 13 through a plurality of support members 223 arranged at intervals in the longitudinal direction. Each of the support members 223 includes a support portion 2231. The support portion 2231 is spaced apart from the web plate 13 and supported on a side of the guide plate 21 close to the web plate 13 and in line and/or surface contact with the guide plate 21. Each of the support members 223 is an integral bent rod structure and includes the support portion 2231 and two connecting portions 2232 connected with an upper end and a lower end of the support portion 2231. Each of the connecting portions 2232 extends from the support portion 2231 toward the web plate 13 and extends through the web plate 13, so as to be snugly connected with the web plate 13 through the nuts 2224. The arrangement of the support members 223 has the following advantages. First, a spacing between the guide surfaces of the guide plates 21 of the two track beams 100 may be finely adjusted, so as to easily meet the accuracy requirements. Second, the welding may be reduced, which is beneficial to the deformation control. Third, the assembly operation can be realized, and the construction is convenient and fast.

Figure 7:
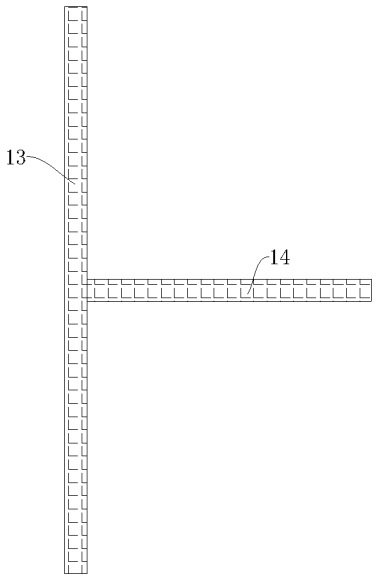
FIG. 7 is a schematic diagram showing connection between a web plate of a track beam and a longitudinal stiffening plate according to an embodiment of the present disclosure.

As shown in FIG. 1 and FIG. 2, the longitudinal stiffening plate 14 is arranged on the track beam assembly 1000 of the present disclosure. Generally, when a span of the steel bridge is not large, and a beam height is relatively small, only the transverse stiffening plate may be arranged on a stiffening rib of the web plate. However, a relatively large transverse horizontal force is applied to the track beam 100 of the present disclosure, including a transverse wind load and a transverse swaying force of the rail vehicle 2000. In order to meet the requirements for driving limits, for example, a cross section of the track beam assembly 1000 may be a cross section with an open top, which has poor transverse bending resistance and overall torsional stiffness. Therefore, in consideration of improving the structural stress distribution, the longitudinal stiffening plate 14 is added. The longitudinal stiffening plate 14 and a partial effective width of the web plate 13 jointly form a T-shaped section. As shown in FIG. 7, the advantages are as follows. First, the out-of-plane stiffness of the web plate 13 is increased to ensure that the web plate 13 can maintain transverse stability when subjected to the transverse force. Second, the torsional stiffness of the cross section of the track beam 100 is increased. In the track beam assembly 1000, a plurality of open box structures arranged in the longitudinal direction are formed through the bottom plate 12, the web plate 13, the longitudinal stiffening plate 14, and the plurality of transverse web plates 2013, so as to have larger torsional stiffness. Third, since a box structure is formed below the web plate 13, the stiffness of the web plate 13 is strengthened, thereby affecting the top plate 11 to strengthen the constraint on the top plate 11 and prevent the top plate from buckling under pressure. Fourth, other stiffening plates of the web plate 13 do not need to be arranged on a side surface of the web plate 13 away from the guide plate 21.

As shown in FIG. 1 and FIG. 2, in the track beam assembly 1000 of the present disclosure, the transverse stiffening plate 15 is arranged on a side surface of the web plate 13 close to the guide plate 21 (e.g., facing the guide plate 21), which has the following advantages. First, the out-of-plane stiffness of the web plate 13 may be increased. Second, constraints on the web plate 13 and the longitudinal stiffening plate 14 are increased to improve the overall stiffness. Third, compared with the off-centered arrangement of the web plate in the related art, the web plate 13 of the present disclosure is located in a middle position, which can reduce the transverse width of the transverse stiffening plate 15, save steel, and reduce the welding amount. Fourth, the appearance of the track beam 100 is improved. An engineering project of the rail vehicle 2000 is generally in an urban area of a city, and an urban landscape is also a significant aspect of success of the engineering project of the rail vehicle 2000. Since the transverse stiffening plates 15 are densely arranged, and it is generally very difficult to arrange them completely vertically during construction, if the transverse stiffening plates 15 are arranged on the side surface of the web plate 13 away from the guide plate 21, that is, the transverse stiffening plates are exposed, the landscape is generally poor.

Figure 8:
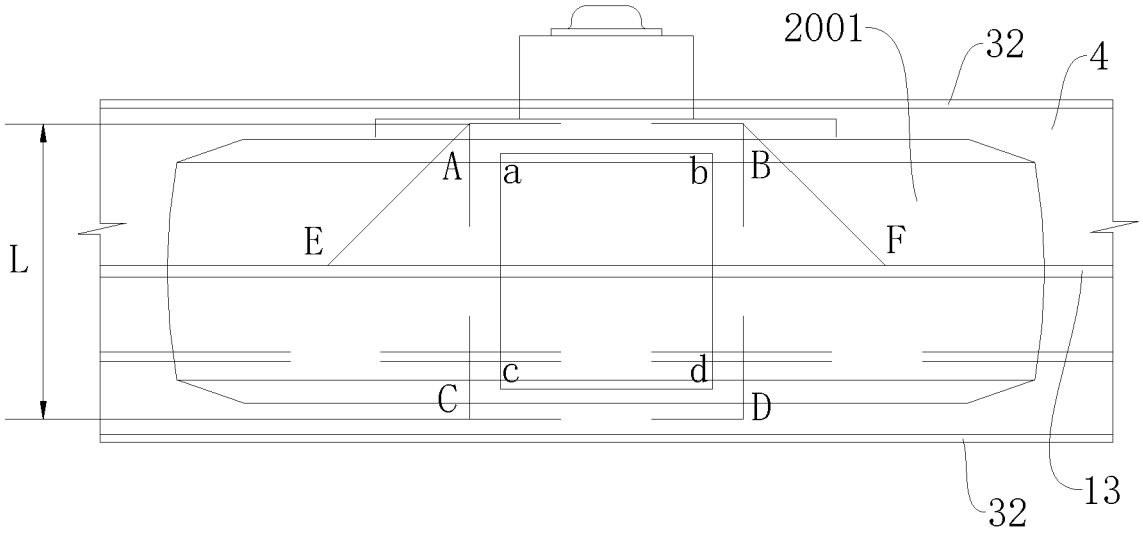
FIG. 8 is a schematic diagram of a pavement structure bearing load according to an embodiment of the present disclosure.
Figure 9:
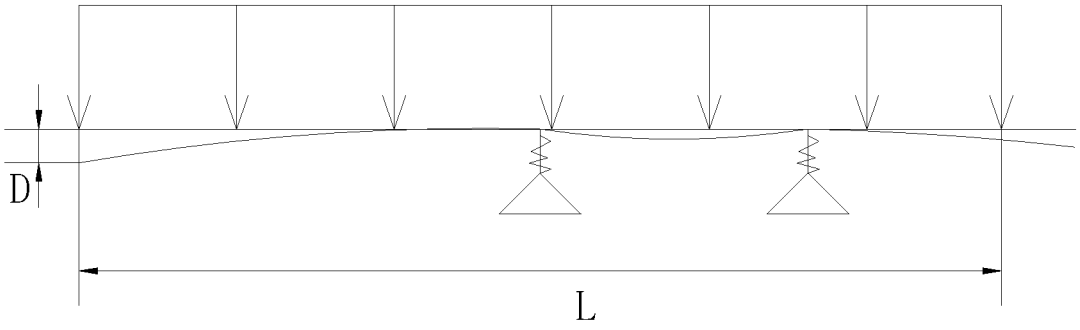
FIG. 9 is a schematic diagram of deflection of a top plate according to an embodiment of the present disclosure.

The track beam assembly 1000 of the present disclosure includes a calculation method without the top plate 11 of the transverse stiffening plate 15. The calculation method includes a control index to prevent cracking of the pavement structure 4 under repeated loads of the walking wheel 2001, that is, a deflection span ratio of the top plate 11. The deflection span ratio of the top plate 11 may range from 600 to 1200, and the formula for the deflection span ratio of the top plate 11 is L/2D. With reference to FIG. 8 and FIG. 9, it should be noted that, the top plate 11 is a cantilever member that bends downward under the load of the walking wheel 2001. L is a transverse stress distribution range of the top plate 11. Since the web plate 13 is in the middle of the top plate 11, L/2 is the calculated span of the cantilever plate, and an actual contact area load between the walking wheel 2001 and the pavement structure 4 is used as a basic parameter, which corresponds to abcd shown in FIG. 8. With the pavement structure 4, the load of the walking wheel 2001 is distributed and diffused in the transverse and longitudinal directions at a first angle, which corresponds to ABCD shown in FIG. 8. A transverse length AC of ABCD is a value of L.

Referring to FIG. 9, D is deflection of the end of the top plate 11 under the load of the walking wheel 2001. The value range of D may be learned through the above value range of the deflection span ratio of the top plate 11 and the value of L. However, D is related to the thickness of the top plate 11, D is further related to a length of EF after the load area ABCD continues to diffuse at a second angle and intersects the center line of the web plate 13. Since the top plate 11 is a cantilevered member without the support of the transverse stiffening plate 15, under the load of the walking wheel 2001, the length AB of the pavement structure 4 in the longitudinal direction after the diffusion also needs to diffuse toward the web plate 13 at a second angle. The length EF is the calculated length of the top plate 11 when being configured to bear the load of the walking wheel 2001. Referring to FIG. 8, the values of the first angle and the second angle are related to relative stiffness between the top plate 11 and the web plate 13, which may vary within a certain range, and 45 degrees may be used during the engineering calculation. After the load, the calculated span L/2, the thickness of the top plate 11, and the calculated length EF are determined, the value of D may be calculated by using the structural mechanics method, or certainly, the thickness of the top plate 11 may be reversely obtained by using the value of D. Therefore, based on the above, the thickness of the top plate 11 may be obtained under the premise of preventing the pavement structure 4 from cracking caused by the repeated loads of the rail vehicle 2000. Further, the thickness of the top plate 11 may be designed in the preliminary design, thereby extending the service life of the pavement structure 4 in the design stage.

In the description of the present disclosure, it should be understood that orientation or position relationships indicated by the terms such as "center", "longitudinal", "transverse", "length", "width", "thickness", "on", "below", "front", "back", "left", "right", "vertical", "horizontal", "top", "bottom", "inside", "outside", "clockwise", "anticlockwise", "axial direction", "radial direction", and "circumferential direction" are based on orientation or position relationships shown in the accompanying drawings, and are used only for ease and brevity of description of the present disclosure, rather than indicating or implying that the mentioned apparatus or element needs to have a particular orientation or be constructed and operated in a particular orientation. Therefore, such terms should not be construed as a limitation on the present disclosure. In addition, a feature defined as "first" or "second" may explicitly or implicitly include one or more features. In the description of the present disclosure, unless otherwise stated, "a plurality of" means two or more than two.

In the description of the present disclosure, it should be noted that, unless otherwise explicitly specified or defined, the terms such as "mount", "connect", and "connection" should be understood in a broad sense. For example, the connection may be a fixed connection, a detachable connection, or an integral connection; or the connection may be a mechanical connection or an electrical connection; or the connection may be a direct connection, an indirect connection through an intermediary, or internal communication between two components. A person of ordinary skill in the art may understand the specific meanings of the foregoing terms in the present disclosure according to specific situations.

In the descriptions of this specification, the description of reference terms such as "one embodiment", "some embodiments", "an exemplary embodiment", "an example", "a specific example", or "some examples" means that specific features, structures, materials, or characteristics described in combination with the embodiment or examples are included in at least one embodiment or example of the present disclosure. In this specification, schematic descriptions of the foregoing terms do not necessarily mean the same embodiment or example. In addition, the described specific features, structures, materials, or characteristics may be combined in a proper manner in any one or more of the embodiments or examples.

Although the embodiments of the present disclosure have been shown and described, a person of ordinary skill in the art should understand that various changes, modifications, replacements, and variations may be made to the embodiments without departing from the principles and spirit of the present disclosure, and the scope of the present disclosure is defined by the claims and their equivalents.

What is claimed is:

1. A track beam, comprising:

a main component, wherein the main component comprises a top plate, a bottom plate, a longitudinal stiffening plate, and a web plate; the longitudinal stiffening plate comprises a planar plate structure extending in a longitudinal direction, the longitudinal stiffening plate is disposed between the top plate and the bottom plate and connected on a side surface of the web plate facing a guide plate, and a transverse end of the longitudinal stiffening plate is welded to the web plate; the bottom plate is disposed below the top plate; and the web plate is connected between the top plate and the bottom plate; and a guide component, wherein the guide component comprises the guide plate and a connecting structure; the guide plate is disposed between the top plate and the bottom plate; the guide plate comprises a planar plate structure extending in the longitudinal direction and is spaced apart from the web plate in a transverse direction; and the connecting structure is connected between the main component and the guide plate such that the guide plate is connected to the main component through the connecting structure.

2. The track beam according to claim 1, wherein the web plate comprises a planar plate structure extending in the longitudinal direction; an upper end of the web plate is connected with the top plate; and/or a lower end of the web plate is connected with the bottom plate.

3. The track beam according to claim 1, wherein the connecting structure is detachably connected with the main component and/or the guide plate.

4. The track beam according to claim 1, wherein the connecting structure is connected with the web plate.

5. The track beam according to claim 4, wherein the connecting structure is threaded or welded to the web plate and the guide plate.

6. The track beam according to claim 1, wherein the connecting structure comprises:

a longitudinal connecting plate, wherein the longitudinal connecting plate comprises a planar plate structure extending in the longitudinal direction; and two transverse ends of the longitudinal connecting plate are respectively connected with the web plate and the guide plate.

7. The track beam according to claim 6, wherein an upper end of the guide plate is welded to the top plate; a lower end of the guide plate is welded to a first end of the two transverse ends of the longitudinal connecting plate; a second end of the two transverse ends of the longitudinal connecting plate is welded to the web plate; or the lower end of the guide plate is welded to the bottom plate; the upper end of the guide plate is welded to the first end of the two transverse ends of the longitudinal connecting plate; and the second end of the two transverse ends of the longitudinal connecting plate is welded to the web plate.

8. The track beam according to claim 1, wherein the connecting structure comprises:

a transverse adjustment assembly, wherein the transverse adjustment assembly is connected between the web plate and the guide plate and is configured to adjust a transverse spacing between the web plate and the guide plate.

9. The track beam according to claim 8, wherein the transverse adjustment assembly comprises a plurality of transverse adjustment mechanisms disposed at intervals in the longitudinal direction; and each of the transverse adjustment mechanisms is connected between the web plate and the guide plate to adjust the transverse spacing between the web plate and the guide plate.

10. The track beam according to claim 9, wherein each of the transverse adjustment mechanisms comprises:

a support rod having a first end and a second end, wherein:

the first end has threads and extends through the web plate to connect with the web plate through a first nut; and the second end is welded to the guide plate; or the first end has threads and extends through the web plate to connect with the web plate through the first nut; and the second end has threads and extends through the guide plate to connect with the guide plate through a second nut; or the first end is welded to the web plate; and the second end has threads and extends through the guide plate to connect with the guide plate through the second nut.

11. The track beam according to claim 1, wherein the connecting structure comprises a plurality of transverse adjustment assemblies, and the transverse adjustment assemblies are disposed at intervals in a vertical direction connecting the guide plate and the web plate.

12. The track beam according to claim 1, wherein the connecting structure comprises:

a support member, wherein the support member is connected between the web plate and the guide plate; the support member comprises a support portion; and the support portion is spaced apart from the web plate in the transverse direction and is supported on a side surface of the guide plate facing the web plate.

13. The track beam according to claim 12, wherein the support member is configured to adjust a transverse spacing between the support portion and the web plate.

14. The track beam according to claim 13, wherein the guide plate is connected with the web plate through a plurality of support members disposed at intervals in the longitudinal direction.

15. The track beam according to claim 12, wherein the support member comprises a bent rod structure comprising the support portion and two connecting portions connected with an upper end and a lower end of the support portion; and each of the connecting portions extends through the web plate to connect with the web plate through nuts.

16. The track beam according to claim 1, wherein the guide component further comprises:

a guide stiffening plate, wherein the guide stiffening plate comprises a transversely arranged planar plate structure extending in the longitudinal direction; the guide stiffening plate is disposed between the guide plate and the web plate; a first transverse end of the guide stiffening plate is connected with the guide plate; and a second transverse end of the guide stiffening plate is spaced apart from the web plate.

17. The track beam according to claim 1, wherein the main component further comprises:

one or more transverse stiffening plates, wherein each of the one or more transverse stiffening plates comprises a planar plate structure extending in the transverse direction; the one or more transverse stiffening plates are disposed at intervals in the longitudinal direction between the top plate and the bottom plate and disposed on the side surface of the web plate facing the guide plate;

and a transverse end of each of the one or more transverse stiffening plates is welded to the web plate.

18. The track beam according to claim 1, further comprising:

a limiting structure, wherein the limiting structure is disposed on a top surface of the top plate, and a groove is defined between the limiting structure and the top plate; or the limiting structure is disposed on a top surface of the bottom plate and the groove is defined between the limiting structure and the bottom plate; and a pavement structure, wherein the pavement structure is paved in the groove.

19. A track beam assembly, comprising a connection beam assembly and one or more track beams, wherein the one or more track beams are disposed and spaced apart in a transverse direction, and the connection beam assembly is connected between the one or more track beams; and each of the one or more track beams comprises:

a main component, wherein the main component comprises a top plate, a bottom plate, a longitudinal stiffening plate, and a web plate; the longitudinal stiffening plate comprises a planar plate structure extending in a longitudinal direction, the longitudinal stiffening plate is disposed between the top plate and the bottom plate and connected on a side surface of the web plate facing a guide plate, and a transverse end of the longitudinal stiffening plate is welded to the web plate; the bottom plate is disposed below the top plate; and the web plate is connected between the top plate and the bottom plate; and a guide component, wherein the guide component comprises the guide plate and a connecting structure; the guide plate is disposed between the top plate and the bottom plate; the guide plate comprises a planar plate structure extending in the longitudinal direction and is spaced apart from the web plate in the transverse direction; and the connecting structure is connected between the main component and the guide plate such that the guide plate is connected to the main component through the connecting structure.

* * * * *